US008876682B2

(12) United States Patent
Benjaminsson et al.

(10) Patent No.: US 8,876,682 B2
(45) Date of Patent: Nov. 4, 2014

(54) FOLDING DEVICE

(75) Inventors: Peter Benjaminsson, Ljungby (SE); Hans Eliasson, Ljungby (SE); Anders Persson, Traryd (SE)

(73) Assignee: Lasermax Roll Systems AB, Ljungby (SE)

( * ) Notice: Subject to any disclaimer, the term of this patent is extended or adjusted under 35 U.S.C. 154(b) by 722 days.

(21) Appl. No.: 13/130,329

(22) PCT Filed: Dec. 10, 2009

(86) PCT No.: PCT/SE2009/051400

§ 371 (c)(1), (2), (4) Date: Jun. 20, 2011

(87) PCT Pub. No.: WO2010/068170

PCT Pub. Date: Jun. 17, 2010

(65) Prior Publication Data

US 2011/0306484 A1 Dec. 15, 2011

(30) Foreign Application Priority Data

Dec. 12, 2008 (SE) ..... 0802559

(51) Int. Cl.
*B31B 1/56* (2006.01)
*B65H 45/22* (2006.01)

(52) U.S. Cl.
CPC ..... *B65H 45/22* (2013.01)
USPC ..... 493/454; 493/405; 493/442

(58) Field of Classification Search
CPC .... B65B 2201/26; B65H 37/00; B65H 45/22; B65H 45/12; B65H 45/30
USPC ..... 493/405, 454, 442; 242/410
See application file for complete search history.

(56) References Cited

U.S. PATENT DOCUMENTS

| | | | | |
|---|---|---|---|---|
| 3,119,537 | A * | 1/1964 | Smits | 226/111 |
| 4,012,674 | A * | 3/1977 | Spitsbergen et al. | 318/7 |
| 4,420,148 | A | 12/1983 | Meadows | |
| 4,664,336 | A * | 5/1987 | Koyama | 242/334.3 |
| 5,230,501 | A | 7/1993 | Melton | |
| 5,833,107 | A * | 11/1998 | Terranova et al. | 226/31 |
| 8,079,539 | B2 * | 12/2011 | Huang et al. | 242/412.1 |

FOREIGN PATENT DOCUMENTS

| | | |
|---|---|---|
| DE | 102007012191 | 9/2008 |
| EP | 1726548 | 11/2006 |
| GB | 2 281 738 | 3/1995 |
| JP | 11-60004 | 3/1999 |

* cited by examiner

*Primary Examiner* — Hemant M Desai
(74) *Attorney, Agent, or Firm* — Tarolli, Sundheim, Covell & Tummino LLP

(57) ABSTRACT

A folding device (100) for folding a paper web (102) in the longitudinal direction includes a first rolling device (104) adapted to receiving the paper web from a supplying device (110). A fold-creating means (106) is adapted to create at least one fold along the paper web. A fold-pressing means (108) is adapted to press together portions of the paper web which are separated by the fold. A second rolling device (109) is adapted to receive and guide the folded paper web out from the folding device to a receiving device (112). At least a first and a second motor (114, 116) are connected to a control unit and are adapted to drive the paper web through the folding device and to maintain a predetermined tension in the paper web.

13 Claims, 4 Drawing Sheets

FOLDING DEVICE

RELATED APPLICATION

This application corresponds to PCT/SE2009/051400, filed Dec. 10, 2009, which claims the benefit of Swedish Application No. 0802559-5, filed Dec. 12, 2008, the subject matter, of which is incorporated herein by reference in its entirety.

TECHNICAL FIELD

The present invention relates to devices for folding a paper web.

BACKGROUND

With the advent of digital processing technology, the technology for mass production of printed matter has changed from being characterised by the material-absorbing and time-consuming operation of printing presses to a more efficient and flexible technology. Long and short runs of printed matter are now produced by high-speed digital printers controlled by computers and interconnected with processing equipment, resulting in a minimum of preparatory work and resetting between production runs. It is most commonly the case that the only resettings and adaptations required between production runs are those which relate to processing equipment connected to the printer. A basic difference between the new digital technology and the old printing press technology is that the whole of each copy of the printed matter, e.g. a book or a folder, is now produced sequentially page by page. The old printing press technology involved the production, sheet by sheet, of a plurality of copies of the same pages, followed by cutting and binding of the sheets, resulting in simultaneous production of a plurality of copies.

One of the advantages of the modern technology as compared with the old printing press technology is that it allows quick resetting from production of one item of printed matter to another and efficient utilisation of the paper (or other material on which printing is done) used in the production process.

However, there are still disadvantages with the new digital production technology. An example is a situation where the requirement is to produce, for example, two different folders or books and the difference is that they have different numbers of pages which are intended to carry print.

With known digital production technology, such a situation is usually dealt with by the printer being so configured that the pages of the two different folders or books are printed parallel with one another along a paper web which runs through the printer. If the number of pages of the two folders or books are different, the amount of paper web surface which carries no print will be directly proportional to the difference in the numbers of pages. Subsequent processing of the printed paper web in the form of cutting, stacking and binding of the two different folders or books will thus lead to scrapping a large amount of unprinted paper.

One way of avoiding this disadvantageous scrapping of unprinted paper is to so configure the printer that the pages of the folders or books are printed on the paper web in such a way that all the pages of a first book or folder are printed across the whole width of the paper web, followed by printing of all the pages of a second book or folder. Depending on the width of the paper web, two or more pages are printed adjacent to one another so that the whole width of the paper web is utilised. If the printed paper web is subsequently run through a folding device before cutting etc., books or folders are thus created in a sequence whereby scrapping of unprinted paper is largely avoided.

As already indicated above, folding devices are therefore a type of processing equipment commonly used in, for example, contexts where folders or books are to be produced in large numbers. A folding device is typically interconnected with a printer which feeds out a continuous web of paper printed with graphic content, and with a cutting device which receives the folded paper web and cuts it in such a way as to result in separate copies of folders or books.

Although the modern technology for mass production of print products has many advantages such as exemplified above, there nevertheless remain a number of disadvantages which afford scope for improvements. The flexibility resulting from sequential mass production also means that the paper web which is provided with print in the printer and runs through a folding device will run at varying speed and will sometimes be stationary. Depending on the amount of time during which it runs slowly or is completely stationary, the paper web will be exposed to a surrounding atmosphere which affects the material of the paper web in such a way that the mechanical tension of the paper web is altered relative to the tension it has when running through the folding device at high speed. This has an adverse effect on the ability of the folding device to create identical folds for every copy of the products being made.

SUMMARY

With the object of eliminating disadvantages of the state of the art, a folding device for folding a paper web in the longitudinal direction is here proposed. The folding device comprises a first rolling device adapted to receiving the paper web from a supplying device, a fold-creating means adapted to creating at least one fold along the paper web, a fold-pressing means adapted to pressing together portions of the paper web which are separated by said fold, a second rolling device adapted to receiving and guiding the printed paper web out from the folding device to a receiving device, and at least a first and a second motor which are connected to a control unit and are adapted to driving the paper web through the folding device and to maintaining a predetermined tension in the paper web irrespective of the speed of the paper web through the folding device.

The fact that the control unit in conjunction with the motors is able to detect the mechanical tension of the paper web and maintain the tension at a predetermined value thus makes it possible to eliminate the adverse effect on the ability of the folding device to create identical folds for every copy of the products being made, independent of the speed of the paper web through the folding device.

Embodiments comprise those where the motor is adapted to maintaining a predetermined tension in the paper web when the latter is stationary. In other words, even when the paper web is stationary during a production process, the adverse effect on the ability of the folding device to create identical folds for every copy of the products being made is eliminated.

The control unit may be adapted to communicating data about the paper web with the supplying device and/or the receiving device.

Embodiments comprise those where the motors are adapted to rotating at least one roller in the first rolling device and/or at least one roller in the second rolling device.

The fold-pressing means may form part of the second rolling device and the fold-creating means may comprise a rotatable folding head.

Some embodiments are such that the folding device comprises at least a second fold-creating means and at least a second fold-pressing means.

Some embodiments are such that at least one paper web sensor is connected to the control unit and adapted to at least detecting presence/absence of a paper web in the folding device. This makes it possible for the control unit to know how a paper web is being drawn through the folding device and to control the motors on the basis of that information.

It should be noted that the expression "paper web" in this context has been adopted for the sake of greater clarity. Paper web is not to be interpreted strictly in terms of wood fibre material but broadly to comprise also other fibre-based materials and other materials, e.g. plastics, suited to being used in printing devices and to being folded, cut and/or bound.

BRIEF DESCRIPTION OF THE DRAWINGS

Embodiments of a folding device are described below in more detail with reference to the attached drawings, in which.

DETAILED DESCRIPTION OF EMBODIMENTS

Figure 1:
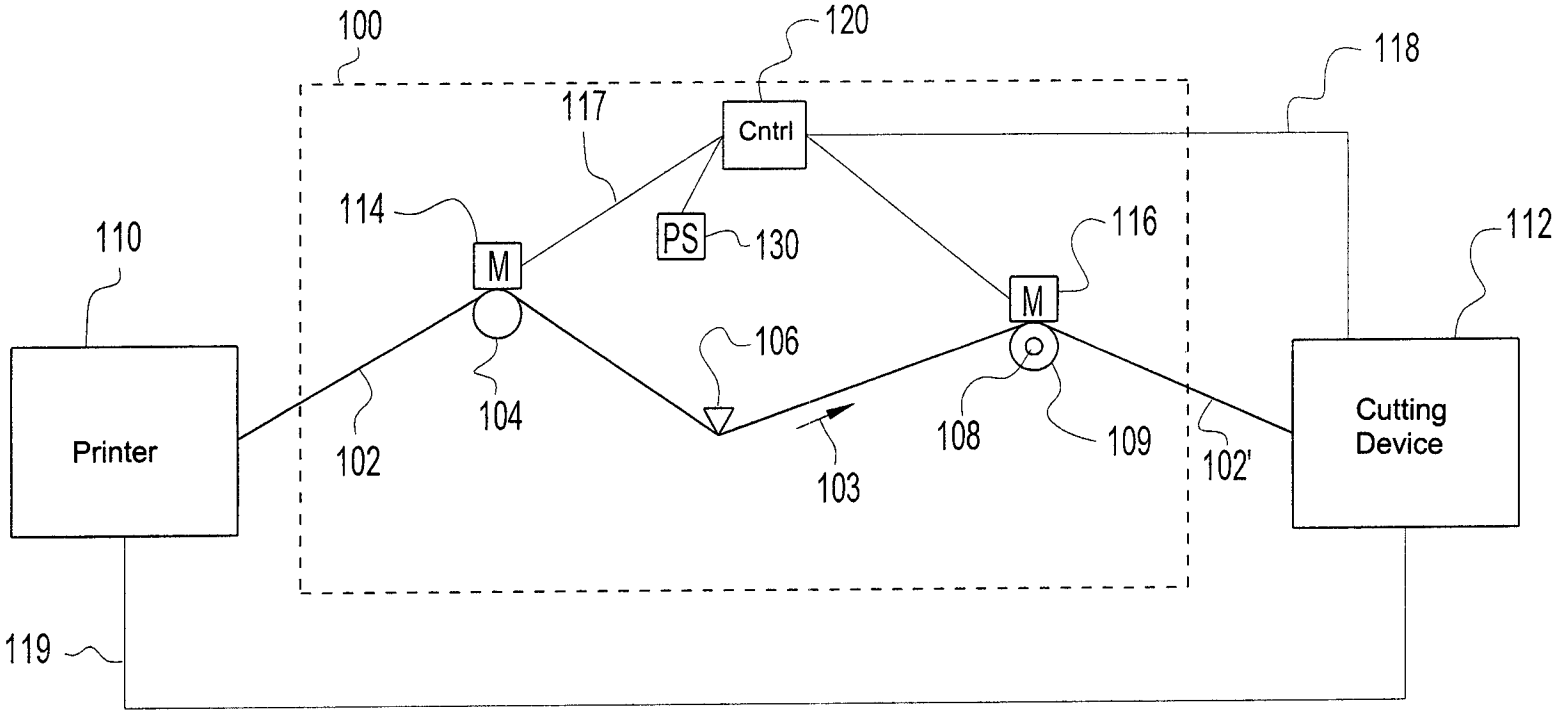
FIG. 1 depicts schematically a system comprising a folding device.

FIG. 1 depicts schematically a folding device 100 interconnected with a printer 110 and a cutting device 112. The printer 110 supplies to the folding device 100 a continuous paper web 102 on which graphic material, e.g. in the form of pages of a book or folder, has been printed by the printer 110. The cutting device 112 receives the folded paper web 102' from the folding device 100 and effects desired cutting so that books or folders are formed. The paper web 102 thus runs in the direction 103 from the printer 110, through the folding device 100 to the cutting device 112.

The folding device 100 comprises a first rolling device 104 adapted to receiving the paper web 102 from the printer 110. A suitable configuration of the first rolling device 104 is that it comprises one or more rollers. A more detailed embodiment with a plurality of rollers will be described in relation to FIGS. 2*a-c* below.

A fold-creating means 106 is situated after the first rolling device 104 downstream in the paper web movement direction 103. This fold-creating means 106 is adapted to creating a fold along the paper web 102. As will be described below, a folding head is a type of fold-creating means.

A fold-pressing means 108 is situated after the fold-creating means 106 downstream in the paper web movement direction 103. This fold-pressing means 108 is adapted to pressing together portions of the paper web 102 which are separated by the fold created by the fold-creating means 106. As will be described below with reference to the FIGS. 2*a-c*, the fold-pressing means 108 may comprise one or more rollers.

A second rolling device 109 is situated after the fold-creating means 106 downstream in the paper web movement direction 103. This second rolling device 109 is adapted to receiving and guiding the folded paper web 102 out from the folding device 100 to the receiving device, which in this case is the cutting device 112.

A first motor 114 is associated with the first rolling device 104 before the fold-creating means 106 upstream in the paper web movement direction 103. A second motor 116 is associated with the second rolling device 109 after the fold-creating means 106 downstream in the paper web movement direction 103. A control unit 120 is connected to the two motors 114, 116.

The motors 114, 116 are adapted to driving the paper web 102 through the folding device 100 and to maintaining a predetermined tension in the paper web 102. The motors 114, 116 have the ability to maintain a predetermined tension in the paper web 102 because they have, in conjunction with the control unit 120, a detection function which detects the electrical characteristics of the motors 114, 116 when they are driving the paper web 102. These characteristics are processed in the control unit 120 together with information which is communicated via a signal line 118 from the cutting device 112. After processing of the information in the control unit 120, the control unit 120 corrects the operation of the motors 114, 116 so that the paper web 102 is kept at a predetermined tension independently of its speed through the folding device. The predetermined tension may for example be a value set by an operator of the folding device 100 or a value communicated from the cutting device 112 or indirectly communicated from the printer 110 via a signal connection 119 between the printer 110 and the cutting device 112. Having information from the printer 110 pass via the cutting device 112 makes it possible for the folding device 100 to be "concealed" from the printer 110, i.e. makes possible a configuration whereby the printer 110 does not know that the paper web fed out by it does not go directly into the cutting device but is processed by the folding device 100.

A paper web sensor 130 is connected to the control unit 120 and adapted to at least detecting presence/absence of the paper web 102 in the folding device 100. This makes it possible for the control unit 120 to know how the paper web 102 is being drawn through the folding device 100 and to control the motors 114, 116 on the basis of that information.

Figure 2A:
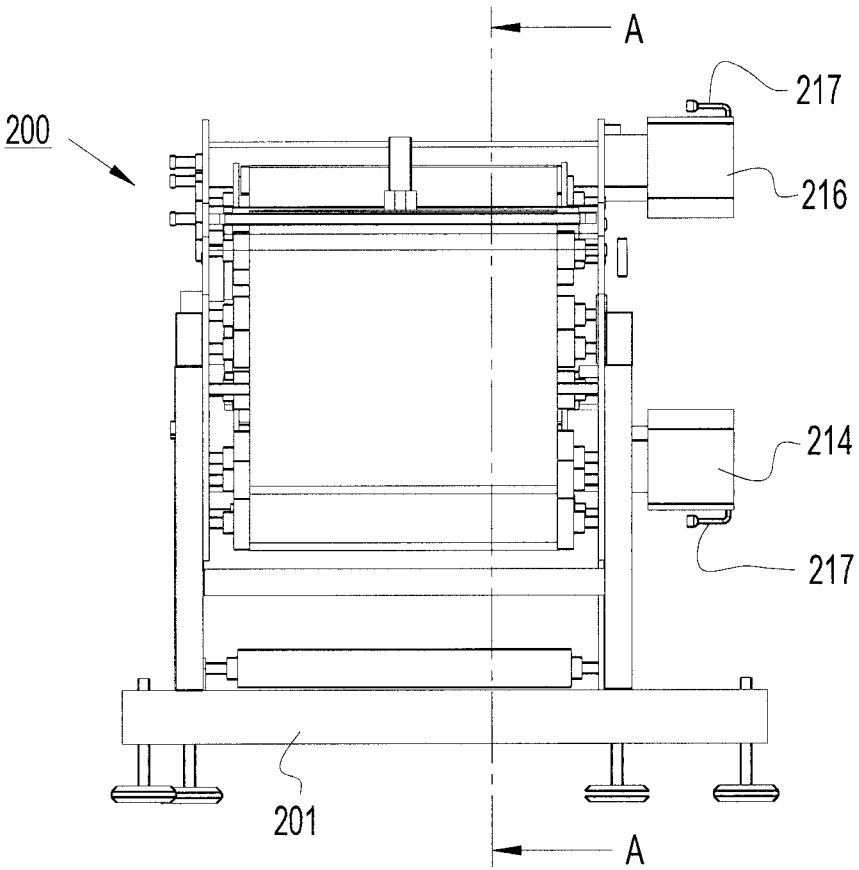
FIG. 2*a* is a view from the side of a folding device.
Figure 2B:
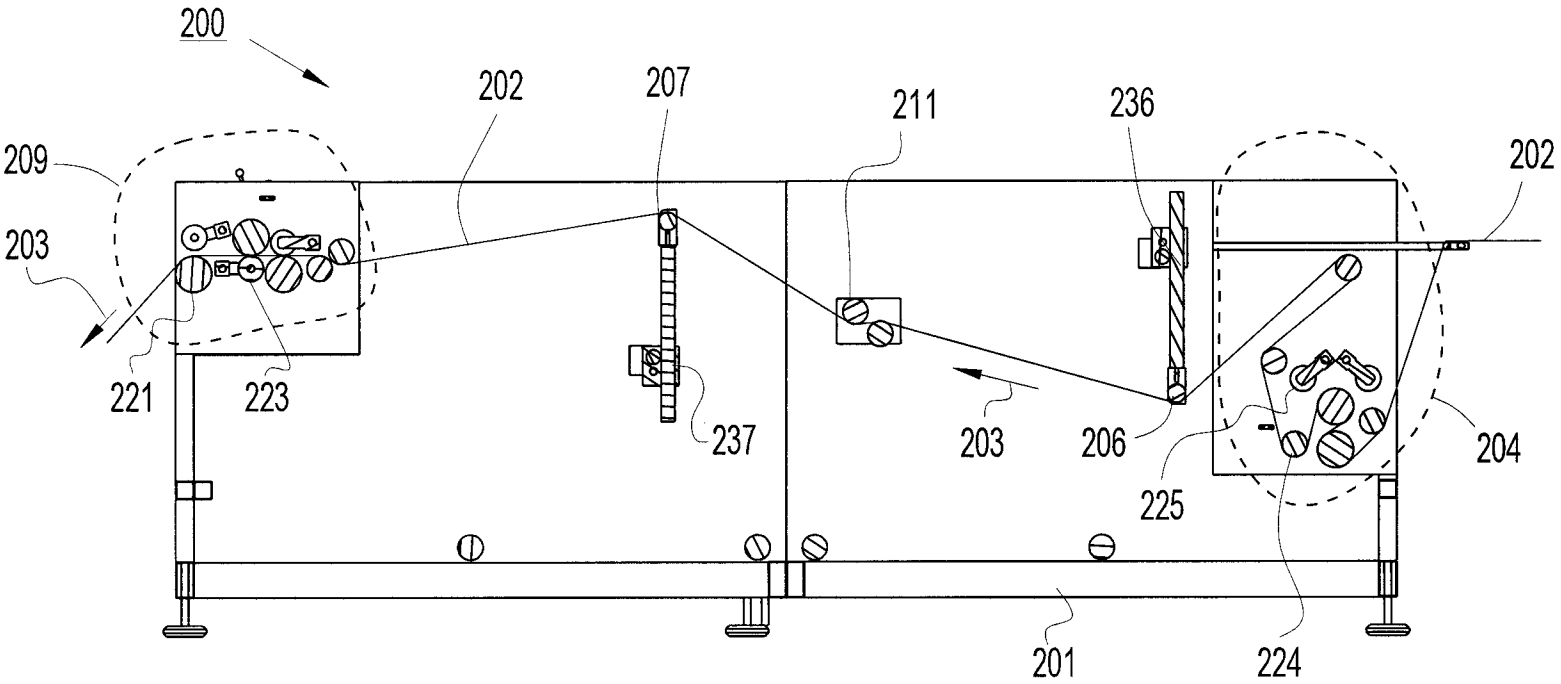
FIG. 2*b* is a view of the cross-section A-A of the folding device in FIG. 2*a*.
Figure 2C:
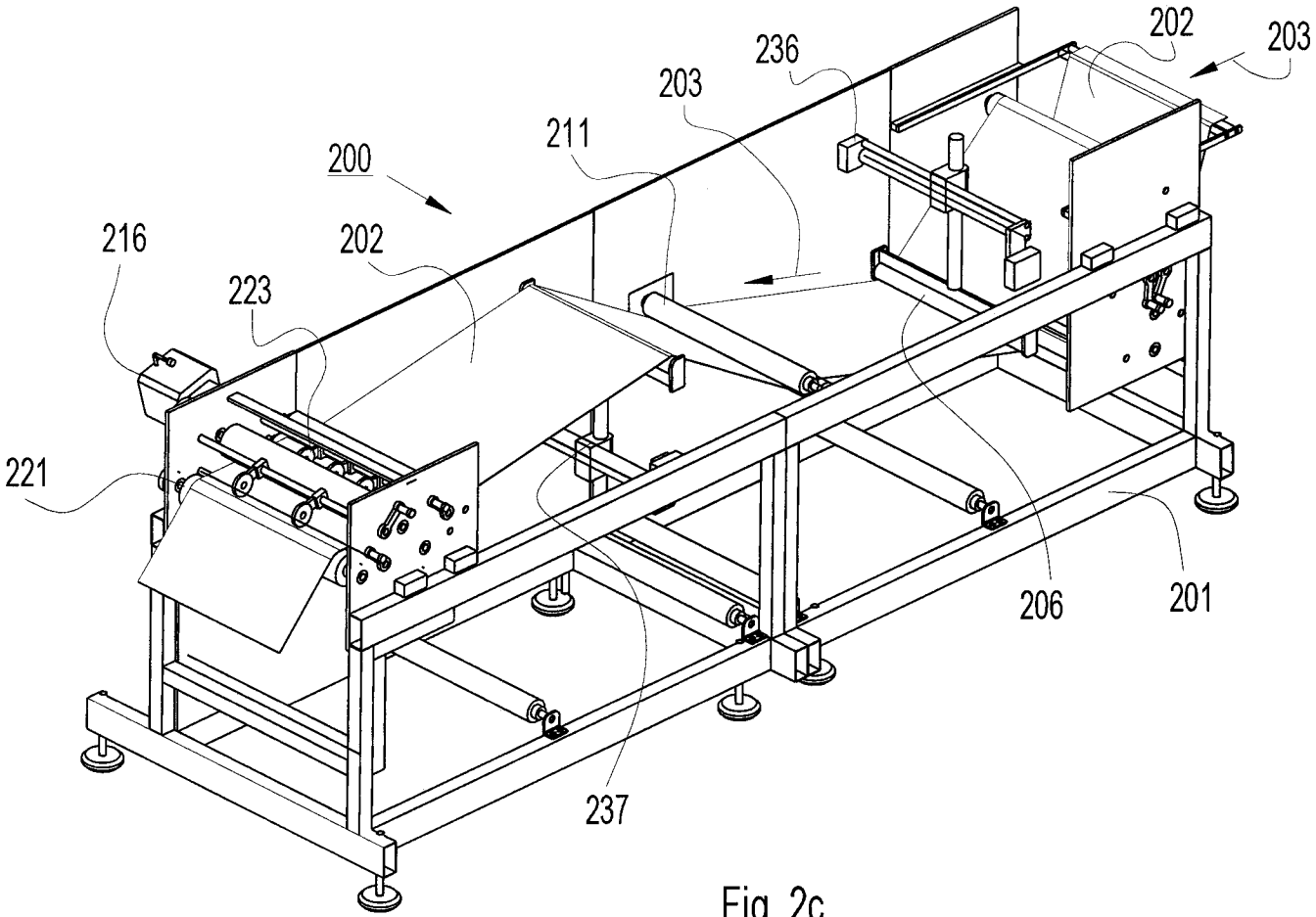
FIG. 2*c* is a perspective view of the folding device in FIGS. 2*a* and 2*b*.

FIGS. 2*a*, 2*b* and 2*c* depict an embodiment of the folding device 200 which comprises more parts than the device 100 depicted schematically in FIG. 1. FIG. 2*a* is a side view, FIG. 2*b* a cross-sectional view and FIG. 2*c* a perspective view of the folding device 200.

The folding device 200 has a loadbearing structure in the form of a frame 201 which comprises a plurality of frame components which are depicted in FIGS. 2*a-c* but will not be described in detail. A first rolling device 204 adapted to receiving a paper web 202 from a printer (not depicted in FIG. 2) is disposed on the frame 201. The first rolling device comprises a plurality of rollers and pressure wheels, exemplified by a roller 224 and a pressure wheel 225. The first rolling device may comprise one or more perforating wheels which create a perforation where the folding is to be effected, with the result that flatter folds are formed.

A first fold-creating means in the form of a folding head 206 mounted on a holder 236 is situated after the first rolling device 204 downstream in the paper web movement direction 203. In addition, a number of supporting rollers 211 downstream of the paper web 202 are followed by a second fold-creating means in the form of a folding head 207 mounted on a holder 237.

The paper web 202 leaves the folding device 200 via a second rolling device 209 which comprises a plurality of rollers and pressure wheels, exemplified by a roller 221 and a pressure wheel 223. The rollers and the pressure wheels in the second rolling device 209 perform the function of pressing the folds in the paper web 202, which folds the folding heads 206 and 207 have created, and feed the paper web 202 to the cutting device (not depicted in FIG. 2).

A first motor 214 is provided at the first rolling device 204 and a second motor 216 is provided at the second rolling device 209. These motors 214, 216 are interconnected with one another and with a control unit (not depicted in FIG. 2) via signal lines 217 in the same way as the device in FIG. 1. The motors 114, 116 drive the paper web 202 through the folding device 200 via rollers and pressure wheels in the two rolling devices.

In a manner similar to the device in FIG. 1, the motors 214, 216 have in conjunction with the control unit (not depicted in FIG. 2) a detection function which detects the electrical characteristics of the motors 214, 216 when they are driving the paper web 202. These electrical characteristics are processed in the control unit (not depicted) together with information which is communicated between the motors 214, 216, via the signal lines 217, and with the cutting device (not depicted in FIG. 2). After processing of the information, the operation of the motors 214, 216 is corrected so that the paper web 202 is kept at a predetermined tension irrespective of its speed through the folding device, and the speed and slippage of the paper web 202 are regulated. The predetermined tension may for example be a value set by an operator of the folding device 200 or a value communicated from the cutting device (not depicted in FIG. 2).

Variants of the folding device 200 may, as described in relation to FIG. 1, be such that at least one paper web sensor is connected to the control unit and adapted to at least detecting presence/absence of a paper web in the folding device 200. This makes it possible for the control unit to know how a paper web is being drawn through the folding device 200 and to control the motors 114, 116 on the basis of that information.

Variants of the folding device 200 may be such that at least a third motor is provided, e.g. between the two fold-creating devices 206, 207, to drive and regulate the paper web in conjunction with the two motors 114, 116. Such variants may be relevant where the material of the paper web and/or other operating parameters make one or more extra motors necessary. One or more extra motors may for example be necessary in variants of the folding device 200 which have further fold-creating means.

The invention claimed is:

1. A folding device (100, 200) for folding a paper web (102, 202) in the longitudinal direction, comprising:
- a first rolling device (104, 204) adapted to receiving the paper web from a supplying device (110),
- a fold-creating means (106, 206) adapted to creating at least one fold along the paper web,
- a fold-pressing means (108, 209) adapted to pressing together portions of the paper web which are separated by said fold,
- a second rolling device (109, 209) adapted to receiving and guiding the folded paper web out from the fold-creating means (106, 206) to a receiving device (112), and
- at least a first and a second motor (114, 214, 116, 216) which are connected to a control unit (120) and are adapted to driving the paper web through the folding device and to maintaining through the control unit, by detecting in conjunction with the control unit the electrical characteristics of the motors when they are driving the paper web, a predetermined tension in the paper web independent of its speed through the folding device as well as when the paper web is stationary.

2. The folding device (100, 200) according to claim 1, in which the control unit (120) is adapted to communicating data about the paper web (102, 202) with the supplying device.

3. The folding device (100, 200) according to claim 1, in which the control unit (120) is adapted to communicating data about the paper web (102, 202) with the receiving device.

4. The folding device (100, 200) according to claim 1, in which said first motor is adapted to rotating at least one roller in the first rolling device (104, 204).

5. The folding device (100, 200) according to claim 1, in which said second motor is adapted to rotating at least one roller in the second rolling device (109, 209).

6. The folding device (100, 200) according to claim 1, in which the fold-pressing means (108, 209) forms part of the second rolling device (109, 209).

7. The folding device (100, 200) according to claim 1, in which the fold-creating means (106, 206) comprises a rotatable folding head.

8. The folding device (100, 200) according to claim 1, in which the folding device comprises at least a second fold-creating means (206) and at least a second fold-pressing means (207).

9. The folding device (100, 200) according to claim 1, comprising at least one paper web sensor (130) connected to the control unit (120) and adapted to at least detecting presence/absence of a paper web (102, 202) in the folding device.

10. The folding device (100, 200) according to claim 1, wherein the fold-creating means (106, 206) is positioned downstream of the first rolling device (104, 204) and upstream of the second rolling device (109, 209).

11. The folding device (100, 200) according to claim 10, wherein the control until (120) controls at least one of the first and second motors to maintain a predetermined tension in the paper web (102, 202) independent of the speed of the paper web (102, 202) through the fold-creating means (106, 206).

12. The folding device (100, 200) according to claim 10, wherein the control until (120) controls at least one of the first and second motors to maintain a predetermined tension in the paper web (102, 202) as the paper web (102, 202) is folded by the fold-creating means (106, 206) and pressed by the fold-pressing means (108, 209).

13. A folding device for folding a paper web in the longitudinal direction comprising:
- a supplying device;
- a first rolling device for receiving the paper web from the supplying device;
- a fold-creating device for creating at least one fold along the paper web;
- a fold-pressing device for pressing together portions of the paper web separated by the fold;
- a second rolling device downstream of the fold-creating device for receiving and guiding the folded paper web from the fold-creating device to a receiving device;
- a control unit; and
- first and second motors connected to the control unit for driving the paper web through the folding device, the control unit detecting electrical characteristics of the first and second motors while the first and second motors drive the paper web through the fold-creating device and fold-pressing device to maintain a predetermined tension in the paper web independent of the speed of the paper web through the folding device as well as when the paper web is stationary.

* * * * *